US009683358B1

(12) United States Patent
Coury

(10) Patent No.: US 9,683,358 B1
(45) Date of Patent: Jun. 20, 2017

(54) TOILET VENTILATION DEVICE

(71) Applicant: David Coury, Royal Palm Beach, FL (US)

(72) Inventor: David Coury, Royal Palm Beach, FL (US)

( * ) Notice: Subject to any disclaimer, the term of this patent is extended or adjusted under 35 U.S.C. 154(b) by 0 days.

(21) Appl. No.: 14/990,190

(22) Filed: Jan. 7, 2016

(51) Int. Cl.
*A47K 13/00* (2006.01)
*E03D 9/052* (2006.01)
*A47K 13/30* (2006.01)

(52) U.S. Cl.
CPC ..... *E03D 9/052* (2013.01); *A47K 13/307* (2013.01)

(58) Field of Classification Search
CPC .. E03D 9/052; E03D 9/04; E03D 9/05; A47K 13/307
USPC ..... 4/209 R, 216, 217, 306, 347, 348, 352, 4/472, 475, 477, 482
See application file for complete search history.

(56) References Cited

U.S. PATENT DOCUMENTS 962,490 A * 6/1910 Bruder ..... E03D 9/052 16/86 A
1,972,076 A * 9/1934 Cross ..... A47K 13/307 4/217
3,333,285 A 8/1967 Null
3,491,382 A * 1/1970 Poister ..... E03D 9/052 4/213
3,942,200 A 3/1976 Pearson
4,402,091 A * 9/1983 Ellis ..... E03D 9/052 4/217
4,556,999 A * 12/1985 Lindley ..... E03D 9/052 4/209 R
5,016,294 A * 5/1991 Canovas ..... E03D 9/052 4/209 R
5,255,395 A 10/1993 Millette
5,355,536 A * 10/1994 Prisco ..... E03D 9/052 4/217
6,775,853 B1 * 8/2004 Szekely ..... A47K 13/307 4/213
8,239,973 B1 * 8/2012 Character ..... A47K 13/307 4/211

* cited by examiner

*Primary Examiner* — Erin Deery
(74) *Attorney, Agent, or Firm* — Stevenson IP, LLC

(57) ABSTRACT

A toilet ventilation device including a toilet seat and a plurality of slots disposed on an interior surface of the toilet seat. A battery-powered light emitting diode is disposed on the interior surface of a rear portion of the toilet seat. A toilet seat attachment is configured to have a shape substantially equal to a shape of the toilet seat. A plurality of attachment pins is disposed on an internal surface of the toilet seat attachment. One of the plurality of attachment pins is configured to removably engage one of the plurality of slots. A plurality of ventilation holes is disposed along the toilet seat attachment. The plurality of ventilation holes is in fluid communication with an air outlet line in fluid communication with an air pump. An exhaust tube is in fluid communication with the air pump, and a pressure activation control is attached to the air pump.

5 Claims, 5 Drawing Sheets

TOILET VENTILATION DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of ventilated toilet seats are known in the prior art. However, what has been needed is a toilet ventilation device including a toilet seat and a plurality of slots disposed on an interior surface of the toilet seat. A battery-powered light emitting diode is disposed on the interior surface of a rear portion of the toilet seat. What has been further needed is a toilet seat attachment configured to have a shape substantially equal to a shape of the toilet seat. A plurality of attachment pins is disposed on an internal surface of the toilet seat attachment. One of the plurality of attachment pins is configured to removably engage one of the plurality of slots. Lastly, what has been needed is a plurality of ventilation holes disposed along the toilet seat attachment, with the plurality of ventilation holes in fluid communication with an air outlet line in fluid communication with an air pump. An exhaust tube is in fluid communication with the air pump, and a pressure activation control is attached to the air pump. The pressure activation control is configured to activate the air pump when a preselected amount of pressure is downwardly applied to the toilet seat attachment in order to draw noxious air from a toilet bowl through the plurality of ventilation holes and out the exhaust tube. The toilet ventilation device thus provides a user with the ability to ventilate the toilet bowl in an efficient and effective manner, since the air pump will only activate when the preselected amount of downward pressure is recognized by the pressure activation control.

FIELD OF THE INVENTION

The present invention relates to ventilated toilet seats, and more particularly, to a toilet ventilation device.

SUMMARY OF THE INVENTION

The general purpose of the present toilet ventilation device, described subsequently in greater detail, is to provide a toilet ventilation device which has many novel features that result in a toilet ventilation device which is not anticipated, rendered obvious, suggested, or even implied by prior art, either alone or in combination thereof.

To accomplish this, the present toilet ventilation device includes a toilet seat having a front portion, a rear portion, a right portion, and a left portion. Each of the front portion, the rear portion, the right portion, and the left portion has an exterior surface and an interior surface. A plurality of slots includes a right front slot, a left front slot, a right rear slot, and a left rear slot. Each of the right front slot and the left front slot is disposed on the interior surface of the right portion of the toilet seat and the left portion of the toilet seat, respectively, proximal the front portion of the toilet seat. Each of the right rear slot and the left rear slot is disposed on the interior surface of the right portion of the toilet seat and the left portion of the toilet seat, respectively, proximal the rear portion of the toilet seat. The right front slot is collinearly disposed with the left front slot, and the right rear slot is collinearly disposed with the left rear slot. A battery-powered light emitting diode is disposed on the interior surface of the rear portion of the toilet seat in order to help guide a user to the location of a toilet.

The toilet ventilation device further includes a toilet seat attachment configured to have a shape substantially equal to a shape of the toilet seat. The toilet seat attachment has a front section, a rear section, a right section, a left section, a continuous outer rim, and a continuous inner rim. Each of the front section, the rear section, the right section, and the left section has an external surface and an internal surface. A plurality of attachment pins includes a right front pin, a left front pin, a right rear pin, and a left rear pin. Each of the right front pin and the left front pin is disposed on the internal surface of the right section of the toilet seat attachment and the left section of the toilet seat attachment, respectively, proximal the front section. Each of the right rear pin and the left rear pin is disposed on the internal surface of the right section of the toilet seat attachment and the left section of the toilet seat attachment, respectively, proximal the rear section. Each of the right front pin, the left front pin, the right rear pin, and the left rear pin is configured to removably and slidingly engage the right front slot, the left front slot, the right rear slot, and the left rear slot, respectively.

A plurality of ventilation holes is continuously disposed along each of the right section of the toilet seat attachment and the left section of the toilet seat attachment, with each of the plurality of ventilation holes disposed from the inner rim of the toilet seat attachment to substantially medially between the inner rim of the toilet seat attachment and the outer rim of the toilet seat attachment. The plurality of ventilation holes is in fluid communication with an air outlet line in fluid communication with a motorized air pump disposed between a front surface of a toilet tank and a top surface of a toilet lid vertically disposed in an open position. The air pump is in operational communication with a power supply mechanism. A pressure activation control is attached to the air pump, and the pressure activation control is configured to activate the air pump when a preselected amount of pressure is downwardly applied to the toilet seat attachment. An exhaust tube is in fluid communication with the air pump. The air pump, the pressure activation control, and the power supply mechanism are in operational communication with each other. The pressure activation control is configured to activate the air pump in order to draw noxious air from a toilet bowl through the plurality of ventilation holes and out the exhaust tube.

Lastly, the toilet ventilation device includes a pair of inverted substantially U-shaped mounting supports including a right mounting support and a left mounting support. The right mounting support is disposed on the external surface of the right section of the toilet seat attachment, and the left mounting support is disposed on the external surface of the left section of the toilet seat attachment. Each of the pair of mounting supports is configured to be removably disposed atop an upper surface of the toilet bowl. The pair of mounting supports ensures a more secure fit of the toilet seat attachment to the toilet bowl.

The power supply mechanism of the toilet ventilation device optionally further includes a power source connector disposed within the air pump and a power cord having a right end attachable to the power source connector and a left end removably attachable to a power source. A top end of the exhaust tube is in fluid communication with the air pump and a bottom end of the exhaust tube is optionally in fluid communication with a siphon of a toilet. Additionally, the power supply mechanism can optionally include a battery disposed on a side surface of the toilet tank, with the top end of the exhaust tube in fluid communication with the air pump and the bottom end of the exhaust tube attached to a charcoal filter disposed on a back surface of the toilet tank. The battery is preferably a lithium battery.

Thus has been broadly outlined the more important features of the present toilet ventilation device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
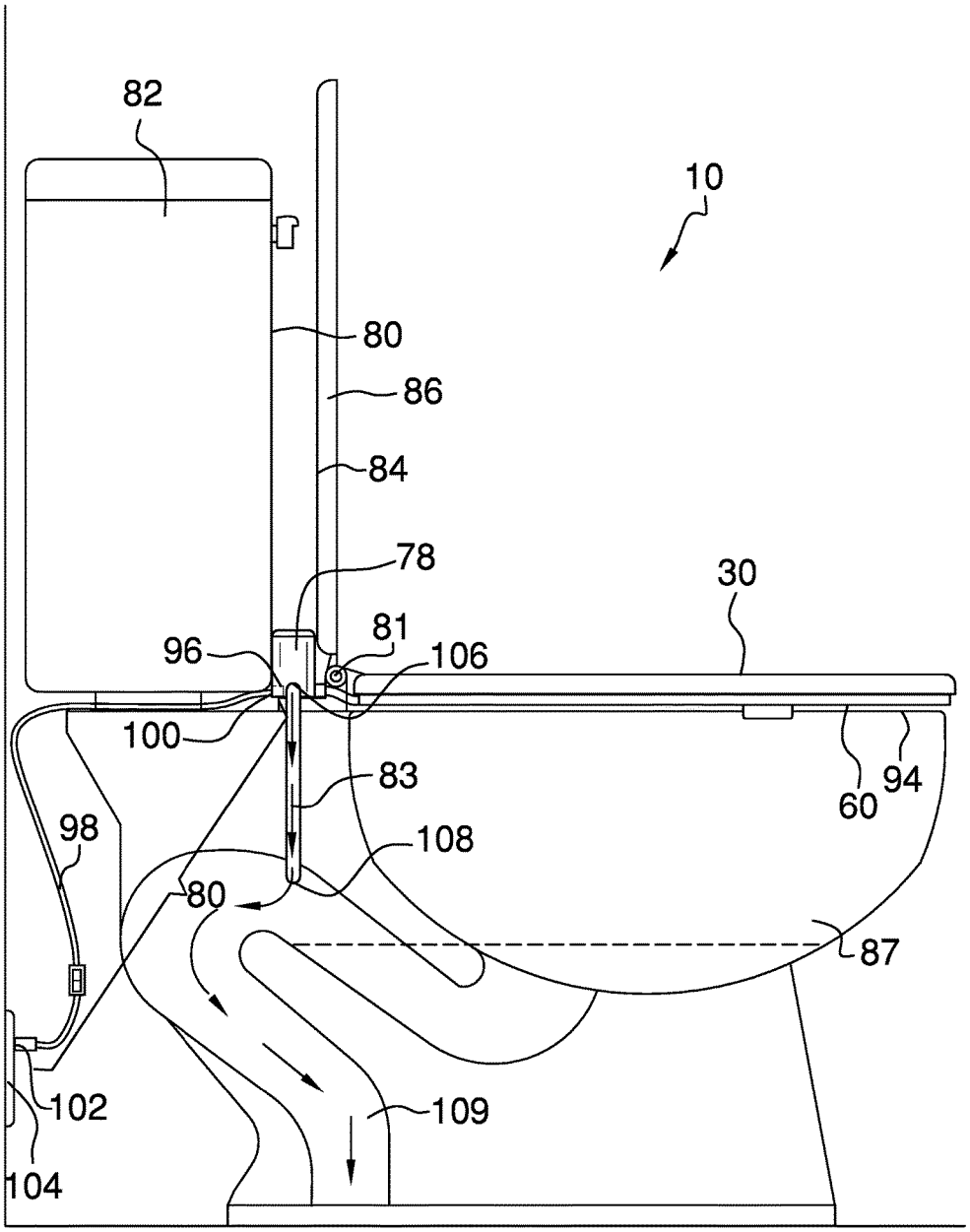
FIG. 1 is an in use view.
Figure 2:
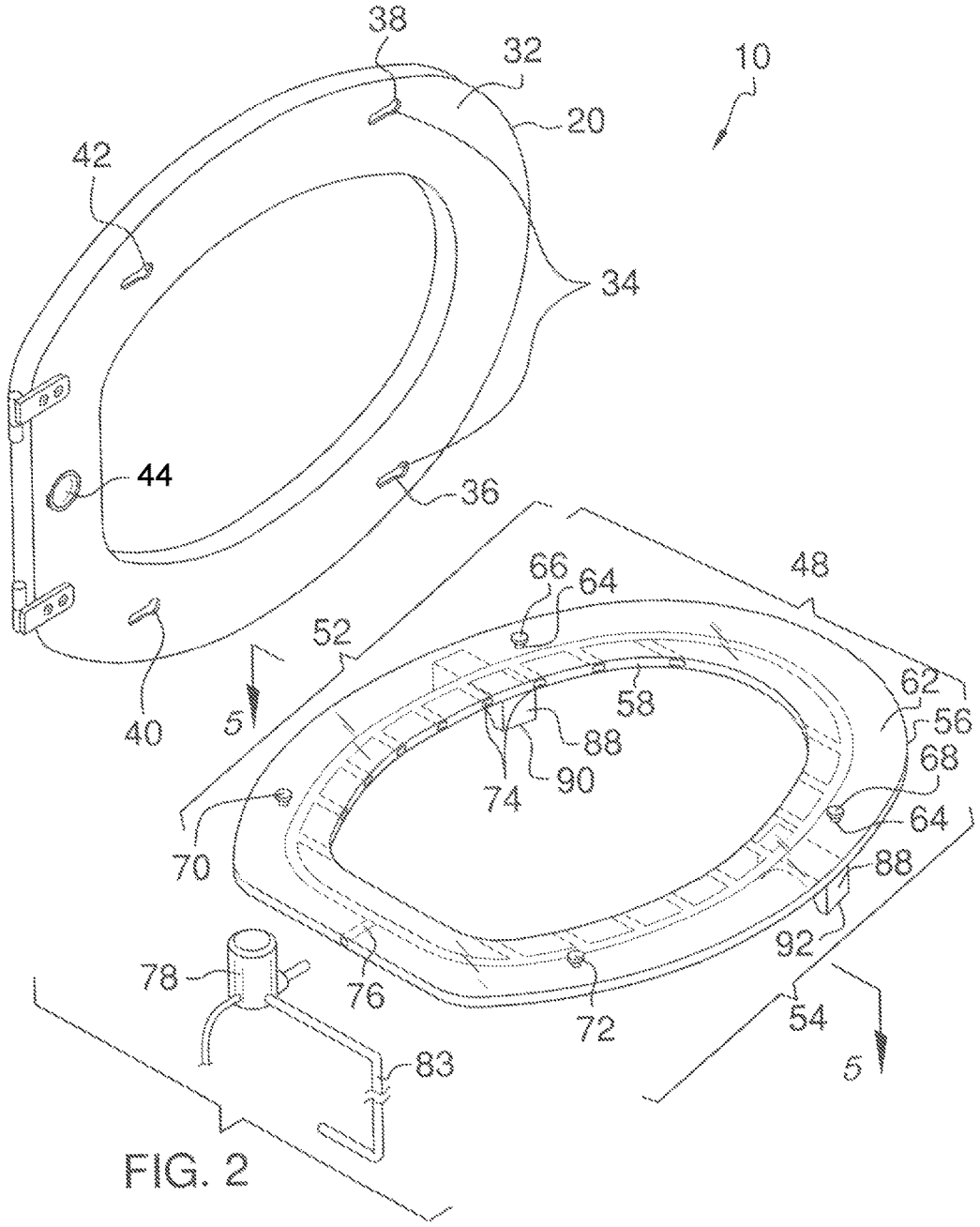
FIG. 2 is a front isometric view.
Figure 3:
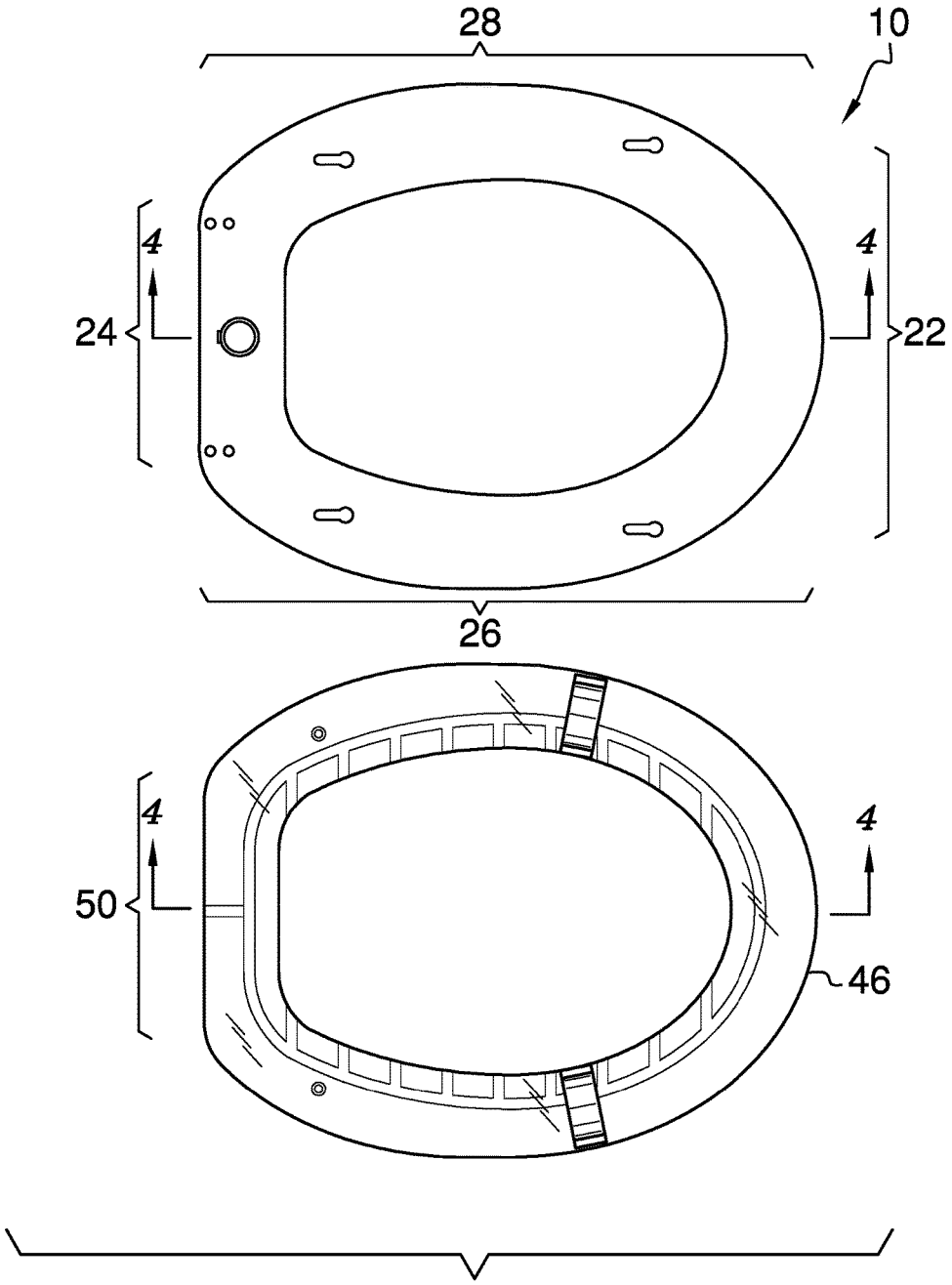
FIG. 3 is a bottom plan view.
Figure 4:
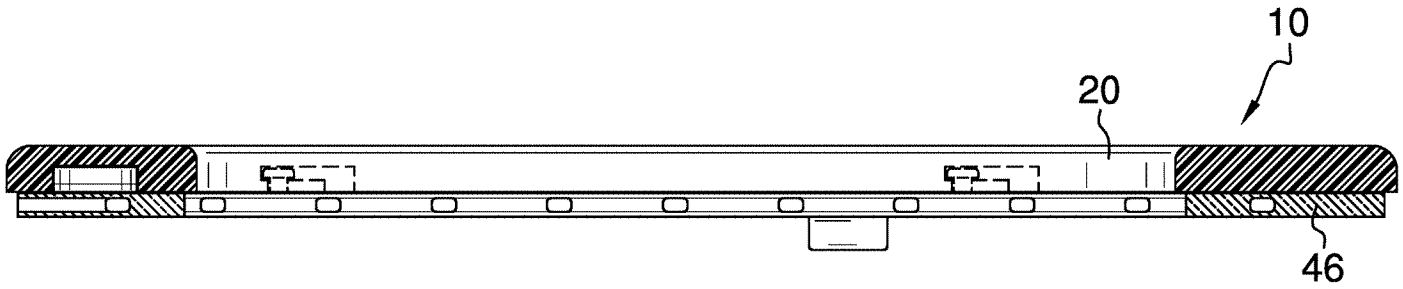
FIG. 4 is a cross-sectional view taken along line 4-4 of FIG. 3.
Figure 5:
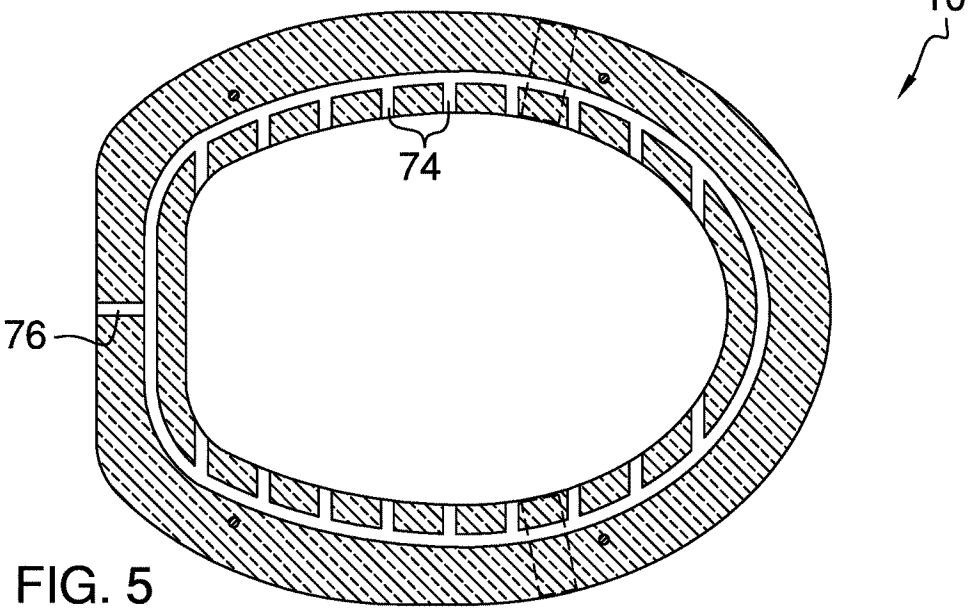
FIG. 5 is a top plan view showing a toilet seat attachment.
Figure 6:
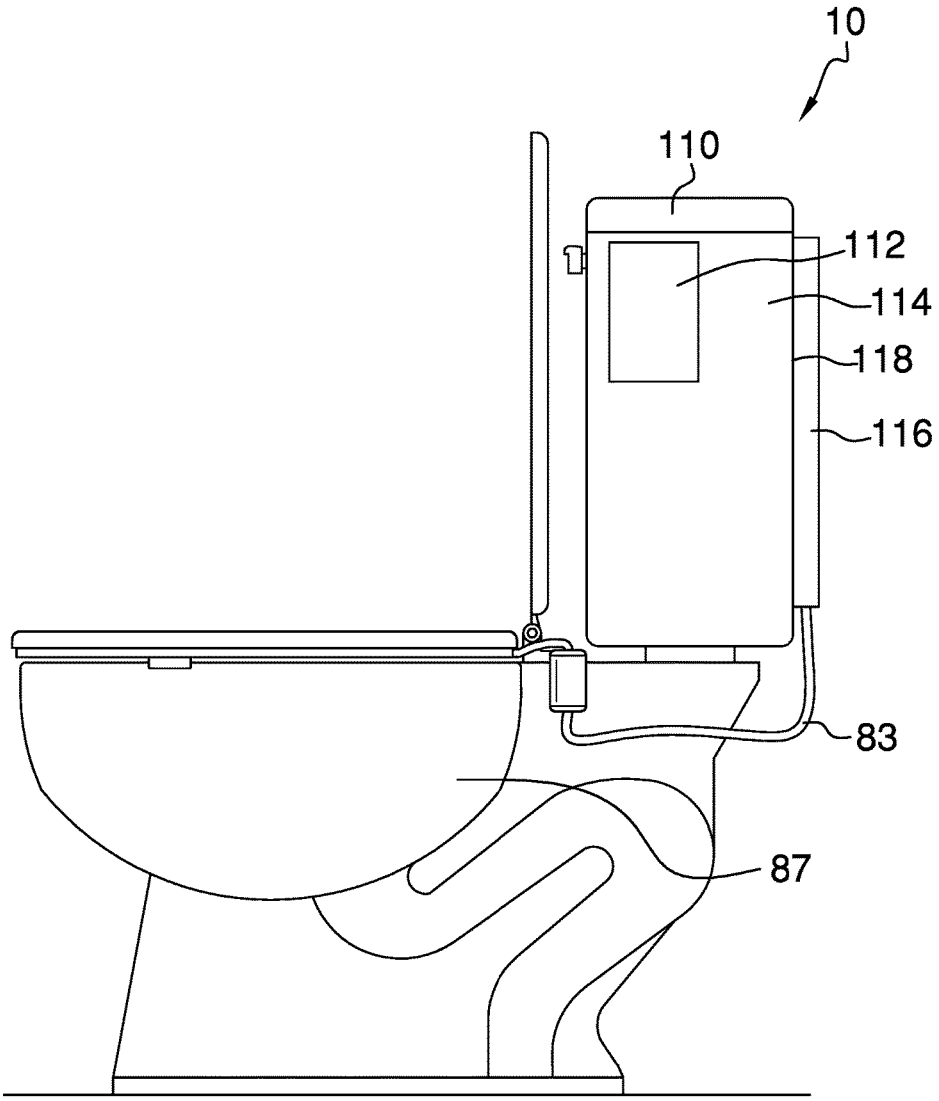
FIG. 6 is an in use view showing a charcoal filter and a battery.

With reference now to the drawings, and in particular FIGS. 1 through 6 thereof, an example of the instant toilet ventilation device employing the principles and concepts of the present toilet ventilation device and generally designated by the reference number 10 will be described.

Referring to FIGS. 1 through 6 the present toilet ventilation device 10 is illustrated. The toilet ventilation device 10 includes a toilet seat 20 having a front portion 22, a rear portion 24, a right portion 26, and a left portion 28. Each of the front portion 22, the rear portion 24, the right portion 26, and the left portion 28 has an exterior surface 30 and an interior surface 32. A plurality of slots 34 includes a right front slot 36, a left front slot 38, a right rear slot 40, and a left rear slot 42. Each of the right front slot 36 and the left front slot 38 is disposed on the interior surface 32 of the right portion 26 of the toilet seat 20 and the left portion 28 of the toilet seat 20, respectively, proximal the front portion 22 of the toilet seat 20. Each of the right rear slot 40 and the left rear slot 42 is disposed on the interior surface 32 of the right portion 26 of the toilet seat 20 and the left portion 28 of the toilet seat 20, respectively, proximal the rear portion 24 of the toilet seat 20. The right front slot 36 is collinearly disposed with the left front slot 38, and the right rear slot 40 is collinearly disposed with the left rear slot 42. A battery-powered light emitting diode 44 is disposed on the interior surface 32 of the rear portion 24 of the toilet seat 20.

The toilet ventilation device 10 further includes a toilet seat attachment 46 configured to have a shape substantially equal to a shape of the toilet seat 20. The toilet seat attachment 46 has a front section 48, a rear section 50, a right section 52, a left section 54, a continuous outer rim 56, and a continuous inner rim 58. Each of the front section 48, the rear section 50, the right section 52, and the left section 54 has an external surface 60 and an internal surface 62. A plurality of attachment pins 64 includes a right front pin 66, a left front pin 68, a right rear pin 70, and a left rear pin 72. Each of the right front pin 66 and the left front pin 68 is disposed on the internal surface 62 of the right section 52 of the toilet seat attachment 46 and the left section 54 of the toilet seat attachment 46, respectively, proximal the front section 48. Each of the right rear pin 70 and the left rear pin 72 is disposed on the internal surface 62 of the right section 52 of the toilet seat attachment 46 and the left section 54 of the toilet seat attachment 46, respectively, proximal the rear section 50. Each of the right front pin 66, the left front pin 68, the right rear pin 70, and the left rear pin 72 is configured to removably and slidingly engage the right front slot 36, the left front slot 38, the right rear slot 40, and the left rear slot 42, respectively.

A plurality of ventilation holes 74 is continuously disposed along each of the right section 52 of the toilet seat attachment 46 and the left section 54 of the toilet seat attachment 46, with each of the plurality of ventilation holes 74 disposed from the inner rim 58 of the toilet seat attachment 46 to substantially medially between the inner rim 58 of the toilet seat attachment 46 and the outer rim 56 of the toilet seat attachment 46. The plurality of ventilation holes 74 is in fluid communication with an air outlet line 76 in fluid communication with a motorized air pump 78 disposed between a front surface 80 of a toilet tank 82 and a top surface 84 of a toilet lid 86 vertically disposed in an open position. The air pump 78 is in operational communication with a power supply mechanism 80. A pressure activation control 81 is attached to the air pump 78, and the pressure activation control 81 is configured to activate the air pump 78 when a preselected amount of pressure is downwardly applied to the toilet seat attachment 46. An exhaust tube 83 is in fluid communication with the air pump 78. The air pump 78, the pressure activation control 81, and the power supply mechanism 80 are in operational communication with each other. The pressure activation control 81 is configured to activate the air pump 78 in order to draw noxious air from a toilet bowl 87 through the plurality of ventilation holes 74 and out the exhaust tube 83.

Lastly, the toilet ventilation device 10 includes a pair of inverted substantially U-shaped mounting supports 88 including a right mounting support 90 and a left mounting support 92. The right mounting support 90 is disposed on the external surface 60 of the right section 52 of the toilet seat attachment 46, and the left mounting support 92 is disposed on the external surface 60 of the left section 54 of the toilet seat attachment 46. Each of the pair of mounting supports 88 is configured to be removably disposed atop an upper surface 94 of the toilet bowl 87.

The power supply mechanism 80 optionally further includes a power source connector 96 disposed within the air pump 78 and a power cord 98 having a right end 100 attachable to the power source connector 96 and a left end 102 removably attachable to power source 104. A top end 106 of the exhaust tube 83 is in fluid communication with the air pump 78 and a bottom end 108 of the exhaust tube 83 is optionally in fluid communication with a siphon 109 of a toilet 110. Additionally, the power supply mechanism 80 can optionally include a battery 112 disposed on a side surface 114 of the toilet tank 82, with the top end 106 of the exhaust tube 83 in fluid communication with the air pump 78 and the bottom end 108 of the exhaust tube 83 attached to a charcoal filter 116 disposed on a back surface 118 of the toilet tank 82.

What is claimed is:

1. A toilet ventilation device comprising:

a toilet seat having a front portion, a rear portion, a right portion, and a left portion, each of the front portion, the rear portion, the right portion, and the left portion having an exterior surface and an interior surface;

a plurality of slots comprising a right front slot, a left front slot, a right rear slot, and a left rear slot, wherein each of the right front slot and the left front slot is disposed on the interior surface of the toilet seat right portion and the toilet seat left portion, respectively, proximal the toilet seat front portion, and each of the right rear slot and the left rear slot is disposed on the interior surface of the toilet seat right portion and the toilet seat left portion, respectively, proximal the toilet seat rear portion;

wherein the right front slot is collinearly disposed with the left front slot, and the right rear slot is collinearly disposed with the left rear slot;

a battery-powered light emitting diode disposed on the interior surface of the toilet seat rear portion;

a toilet seat attachment configured to have a shape substantially equal to a shape of the toilet seat, the toilet seat attachment having a front section, a rear section, a right section, a left section, a continuous outer rim, and a continuous inner rim, each of the front section, the rear section, the right section, and the left section having an external surface and an internal surface;

a plurality of attachment pins comprising a right front pin, a left front pin, a right rear pin, and a left rear pin, wherein each of the right front pin and the left front pin is disposed on the internal surface of the toilet seat attachment right section and the toilet seat attachment left section, respectively, proximal the front section, and each of the right rear pin and the left rear pin is disposed on the internal surface of the toilet seat attachment right section and the toilet seat attachment left section, respectively, proximal the rear section, wherein each of the right front pin, the left front pin, the right rear pin, and the left rear pin is configured to removably and slidingly engage the right front slot, the left front slot, the right rear slot, and the left rear slot, respectively;

a plurality of ventilation holes continuously disposed along each of the toilet seat attachment right section and the toilet seat attachment left section, each of the plurality of ventilation holes disposed from the toilet seat attachment inner rim to substantially medially between the toilet seat attachment inner rim and the toilet seat attachment outer rim, wherein the plurality of ventilation holes is in fluid communication with an air outlet line in fluid communication with a motorized air pump disposed between a front surface of a toilet tank and a top surface of a toilet lid vertically disposed in an open position, wherein the air pump is in operational communication with a power supply mechanism;

a pressure activation control attached to the air pump, wherein the pressure activation control is configured to activate the air pump when a preselected amount of pressure is downwardly applied to the toilet seat attachment;

an exhaust tube in fluid communication with the air pump;

wherein the air pump, the pressure activation control, and the power supply mechanism are in operational communication with each other;

wherein the pressure activation control is configured to activate the air pump in order to draw noxious air from a toilet bowl through the plurality of ventilation holes and out the exhaust tube; and a pair of inverted substantially U-shaped mounting supports comprising a right mounting support and a left mounting support, the right mounting support disposed on the external surface of the toilet seat attachment right section and the left mounting support disposed on the external surface of the toilet seat attachment left section, wherein each of the pair of mounting supports is configured to be removably disposed atop an upper surface of the toilet bowl.

2. The toilet ventilation device of claim 1 wherein the power supply mechanism further comprises a power source connector disposed within the air pump and a power cord having a right end attachable to the power source connector and a left end removably attachable to a power source.

3. The toilet ventilation device of claim 2 wherein a top end of the exhaust tube is in fluid communication with the air pump and a bottom end of the exhaust tube is in fluid communication with a siphon of a toilet.

4. The toilet ventilation device of claim 1 wherein the power supply mechanism is a battery disposed on a side surface of the toilet tank.

5. The toilet ventilation device of claim 4 wherein a top end of the exhaust tube is in fluid communication with the air pump and a bottom end of the exhaust tube is attached to a charcoal filter disposed on a back surface of the toilet tank.

* * * * *